US010717561B2

(12) United States Patent
Govers et al.

(10) Patent No.: US 10,717,561 B2
(45) Date of Patent: Jul. 21, 2020

(54) LAYOUT AND BOX FOLDED FROM THE LAYOUT SUITABLE FOR WASTE

(71) Applicant: Bioboxx Trading B.V., Groningen (NL)

(72) Inventors: Johannes Coenraad Govers, Zuidwolde (NL); Harman Bonno De Jonge, Assen (NL); Wim Meulman, Stadskanaal (NL); Petrus Wilhelmus Laagland, Uden (NL)

(73) Assignee: Bioboxx Trading B.V., Groningen (NL)

( * ) Notice: Subject to any disclaimer, the term of this patent is extended or adjusted under 35 U.S.C. 154(b) by 0 days.

(21) Appl. No.: 15/526,605

(22) PCT Filed: Nov. 4, 2015

(86) PCT No.: PCT/NL2015/050770
§ 371 (c)(1),
(2) Date: May 12, 2017

(87) PCT Pub. No.: WO2016/076706
PCT Pub. Date: May 19, 2016

(65) Prior Publication Data

US 2017/0320614 A1 Nov. 9, 2017

(30) Foreign Application Priority Data

Nov. 14, 2014 (NL) ..... 2013818

(51) Int. Cl.
*B65D 5/24* (2006.01)
*B65D 5/44* (2006.01)
(Continued)

(52) U.S. Cl.
CPC ..... *B65D 5/241* (2013.01); *B65D 5/244* (2013.01); *B65D 5/4279* (2013.01); *B65D 5/443* (2013.01);
(Continued)

(58) Field of Classification Search
CPC ..... B65D 5/241; B65D 5/244; B65D 5/4279; B65D 5/443; B65D 5/4608; B65D 5/5455;
(Continued)

(56) References Cited

U.S. PATENT DOCUMENTS 1,813,298 A * 7/1931 Klin ..... B65D 5/524 206/45.29
3,067,924 A 12/1962 Baker et al.
(Continued)

FOREIGN PATENT DOCUMENTS

DE 3811300 A1 10/1989
DE 202010006548 U1 9/2010
(Continued)

*Primary Examiner* — Christopher R Demeree
(74) *Attorney, Agent, or Firm* — The Webb Law Firm

(57) ABSTRACT

The invention relates to a layout for a box, having a bottom wall, four sidewalls and a cover, wherein the sidewalls each share a crease line with the bottom wall; wherein adjacent sidewalls share a connecting surface, which connecting surface shares a crease line with each of the two adjacent sidewalls; wherein the connecting surfaces are provided with at least one diagonal crease line; wherein the at least one diagonal crease line of the connecting surface coincides in one point with both crease lines between each of the adjacent sides and the bottom wall.

10 Claims, 8 Drawing Sheets

(51) Int. Cl.

| | |
|---|---|
| ***B65D 5/42*** | (2006.01) |
| ***B65D 5/468*** | (2006.01) |
| ***B65D 5/54*** | (2006.01) |
| ***B65D 5/66*** | (2006.01) |
| ***B65D 5/56*** | (2006.01) |
| ***B65D 5/62*** | (2006.01) |
| *B65D 81/28* | (2006.01) |
| *B65D 65/46* | (2006.01) |

(52) U.S. Cl.
CPC ..... *B65D 5/4608* (2013.01); *B65D 5/5455* (2013.01); *B65D 5/563* (2013.01); *B65D 5/62* (2013.01); *B65D 5/6652* (2013.01); *B65D 5/6664* (2013.01); *B65D 65/466* (2013.01); *B65D 81/28* (2013.01)

(58) Field of Classification Search
CPC ..... B65D 5/563; B65D 5/62; B65D 5/6652; B65D 5/6664; B65D 5/22
USPC ..... 229/100, 186, 147, 149, 176, 117.13, 229/154, 172, 174
See application file for complete search history.

(56) References Cited

U.S. PATENT DOCUMENTS

| | | | | |
|---|---|---|---|---|
| 3,572,576 | A | 3/1971 | Foster | |
| 4,119,265 | A * | 10/1978 | Dlugopolski | B65D 5/0035 229/154 |
| 6,029,886 | A * | 2/2000 | Sheffer | B65D 5/0035 229/167 |
| 8,550,246 | B2 | 10/2013 | Hofgartner | |
| 8,939,350 | B2 * | 1/2015 | Valencia | B65D 5/244 229/103.3 |
| 9,220,383 | B2 * | 12/2015 | Ito | A47K 11/02 |
| 9,505,516 | B2 * | 11/2016 | Hubbard, Jr. | B65D 5/2047 |
| 2006/0151584 | A1 | 7/2006 | Wonnacott | |
| 2009/0172872 | A1 * | 7/2009 | Macey | A47K 11/06 4/451 |
| 2012/0234715 | A1 | 9/2012 | Costanzo, Jr. | |

FOREIGN PATENT DOCUMENTS

| | | | |
|---|---|---|---|
| GB | 149566 | | 8/1920 |
| GB | 2441523 | A | 12/2008 |
| GB | 2468193 | A | 9/2010 |
| GB | 2468336 | A | 9/2010 |
| GB | 2475727 | A | 6/2011 |
| JP | 2001328622 | A | 11/2001 |
| JP | 200268170 | A | 3/2002 |
| JP | 2014105000 | A | 6/2014 |
| WO | 2004045971 | A2 | 6/2004 |
| WO | 2006092018 | A1 | 9/2006 |
| WO | 2012095666 | A2 | 7/2012 |
| WO | 2012104588 | A1 | 8/2012 |

* cited by examiner

LAYOUT AND BOX FOLDED FROM THE LAYOUT SUITABLE FOR WASTE

CROSS-REFERENCE TO RELATED APPLICATIONS

This application is the United States national phase of International Application No. PCT/NL2015/050770 filed Nov. 4, 2015, and claims priority to Dutch Patent Application No. 2013818 filed Nov. 14, 2014, the disclosures of which are hereby incorporated in their entirety by reference.

BACKGROUND OF THE INVENTION

Field of the Invention

The invention relates to a box suitable for the collection of waste.

Description of Related Art

More specifically, the invention relates to a box for bio-organic waste, which waste can contain liquid, which box can be processed in a bio-organic waste processing cycle without the need of separating the box from the waste.

In the art, bio-organic waste is collected in sack in box type of collecting systems, such as the international application WO2012095666 suggests. Here a body is provided for holding a flexible liner, in which the waste is collected.

Disadvantages are that the bags need to be lifted out of the box, the bags can tear, and need to be closed manually. The bags need to have sufficient strength, and thus sufficient wall thickness to withstand the forces acted thereon. Thus quite some plastic material is involved in this recycling. This renders a waste system based on bags cumbersome and relative expensive. Further the plastic material, though possibly made from compostable bio-materials such as polylactic-acid (PLA) is digested at very slow pace.

Accordingly it is an object of the invention to mitigate or solve the above described and/or other problems of waste collection in the art, while maintaining and/or improving the advantages thereof.

More specifically the object of the invention can be seen in providing a relative simple system, where time is saved, no separation of container and waste is necessary, that is cost effective and save.

SUMMARY OF THE INVENTION

These and/or other objects are reached by a layout for a box, having a bottom wall, four sidewalls and a cover; wherein the sidewalls each share a crease line with the bottom wall; wherein adjacent sidewalls share a connecting surface, which connecting surface shares a crease line with each of the two adjacent sidewalls; wherein the connecting surfaces are provided with at least one diagonal crease line; wherein the at least one diagonal crease line of the connecting surface coincides in one point with both crease lines between each of the adjacent sides and the bottom wall, wherein the connecting surfaces are provided with connecting tabs, wherein the cover is provided with openings configured for engaging with the connecting tabs of the connecting surfaces.

The connecting surfaces can be configured to be folded and arranged on the inside of the box.

The connecting surfaces are provided with connecting tabs, which can snap pairwise into openings in the cover.

Thus a sturdy box is obtained, which is able to hold liquid containing material. Because the connecting surfaces fold inwardly, the hand grip openings in the side walls, are at the inside of the box covered by the connecting surfaces. Thus when a person is lifting the box, it will be impossible that his hands come into contact with the content of the box. This is advantageous, since the material contained in the box can be contagious, toxic and/or contaminated with germs. Furthermore, the connecting surfaces can prevent any of the contents of the box from exiting through the hand grip openings.

Thus the layout can be folded to a box, wherein the sidewalls and the connecting surfaces are folded thus that the sidewalls and the connecting surfaces form a closed perimeter around all sides of the box up to the top edges of the sidewalls. Thus if liquid containing material or liquid is put in the box, once it is folded together, it have to pass through the wall material in order to escape. Nowhere around the perimeter of the box will the liquid be confronted with cutting lines or perforations in the walls.

By this folding technique, the box can hold up to 85% of its volume in liquid, without leaking out of the box. When the connecting surfaces are folded inside the box, a corner of the material may be removed in order to allow space to fold the connecting surfaces inward. If the connecting surfaces are however folded to the outside of the box, no such removal of material may be necessary. In that case, the box may even hold up to its entire volume liquid, without being able to escape.

The cover of the box can share at its proximal side a crease line with one sidewall; wherein the cover can share two mutually opposite crease lines with connecting tabs; which connecting tabs can be configured and shaped to fit in between the inwardly folded connecting surfaces and the sidewalls.

Thus when the walls are folded up, to shape the box, the connecting surfaces are folded inwardly along the diagonal crease lines, and the connecting tabs are inserted in between the connecting surfaces and the sidewalls, in order to obtain a sturdy box, that maintains its shape, even when loaded with heavy waste material. Thus, no waste material, not even the liquid that may be contained therein can escape the box.

The cover can at its distal end be provided with a connection tab, configured to be affixed to the sidewall opposing the sidewall sharing a crease line with the cover.

Thus the layout can be shaped as a tube like structure, and can still be folded flat. This renders storage of the containers relative easy, while morphing the tube like shape into the final box is self-instructive and self-evident.

The cover can be provided with a lid, which lid is configures to hinge on the crease line between the cover and the sidewall which is connected to the cover. Thus the box can be sealed after use, when full with waste.

The lid can be provided with a first half cut template, and a second half cut template, wherein the first and second half cut templates are, seen in the plane of the lay out, at least partially mutually shifted and the first and second half cut are made in the material of the lay out from mutually opposite sides of the material of the layout. The intricacy of the half cuts can make the box more easy to close and can provide for a better seal, e.g. when the box is full with waste.

The invention relates to a box folded from the layout as described herein above as well. The material of the box can be a solid card board, of which the inside surface can be covered with a water repelling coating.

Thus the box can contain liquid or liquid containing waste, while the liquid is not seeping into the cardboard structural material of the box. The water repelling coating can comprise polylacticacid, polybutaricacid, a polyethylene, polypropylene, polyfluorcarbon, industrial coatings of various substances, for example Xylan dry-film lubricants, which are composites of fluoropolymers nanoparticles, and typically PE, PTFE, PFA, and FEP and/or reinforcing thermoset polyimide and/or polyamide binder resins, which are initially suspended in a suitable solvents. Also polylactic acid, PLA or other biobased materials such as PHA, poly hydroxy acid, can be uses as components of the coating. The coating material can also comprise waxes such as stearine and/or parafine. The coating may comprise antibacterial and/or fungicidal, biocidal, or other compounds in order to minimise growth of unwanted living organisms, including unwanted rodents, insects, pests, fungi, bacteria etc. These compounds may be contained within any of the waxes or polymers, being applied as coating.

These compound may be of use when e.g. the boxes are used to collect diapers, or when they are used in airplanes to collect on board waste. The invention further relates to a frame configured to hold a box as described herein above; comprising a frame structure, a first lid and a second lid; wherein the first lid is configured to engage and hold in place the box according to any of claims 1-9; wherein the second lid is provided with an engagement space, configured to engage with the lid of the box; wherein the second lid is configured to hinge on the frame around an axis, which axis coincides or is spatially close to the crease line between the cover and the sidewall which is connected to the cover of a box according to any of claims 6-9 which is placeable in the frame.

Thus the box can be substantially airtight be sealed off with a lid, such that odours may be prevented from escaping and flies and other animals may be prevented from entering.

The frame can be provided with sets of rotatable supports for supporting boxes as meant herein above, which may be of different sizes. These support sets render the frame more flexible, when e.g. low volumes of waste are processed a smaller box may be used, whereas when higher volumes of waste is produced, a larger box may be used.

The sets of rotatable supports can have a first position configured to support a relative small box and can have a second position configured to allow sufficient space for a relative large box to fit in between. Thus the flexibility can be enhanced.

The invention also relates to a combination of a frame and a box. Since the box and frame are designed to mutually fit, the combination can provide for the entire waste collection system for users. The boxes are sized thus that they can be easily stacked in a standard roll container.

BRIEF DESCRIPTION OF THE DRAWINGS

In order to further elucidate the invention, exemplary embodiments will be described with reference to the figures. In the figures.

DETAILED DESCRIPTION OF THE INVENTION

Figure 1:
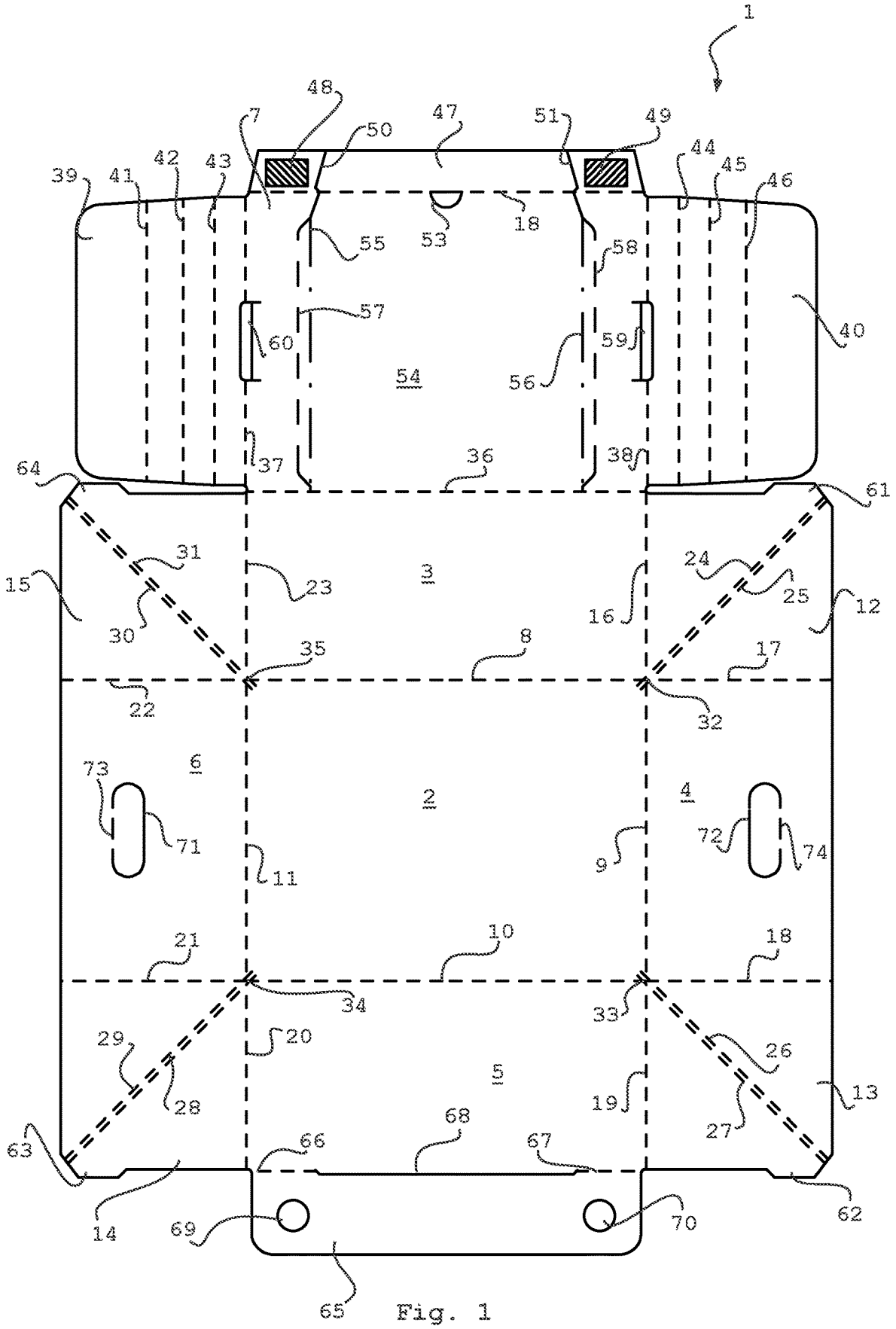
FIG. 1 depicts a first schematic top side view of a layout according to a first embodiment of the invention.

The figures represent specific exemplary embodiments of the inventions and should not be considered limiting the invention in any way or form. Throughout the description and the figures the same or corresponding reference numerals are used for the same or corresponding elements.

The expression "distal end" used herein is to be understood as, though not to be considered limited to the end of part that is loose, not connected, and most distant from the main structure contrary to the proximal end.

The expression "proximal end" used herein is to be understood as, though not to be considered limited to the end of a part that is connected to and most close to the main structure, contrary to the distal end.

The expression "half cut" used herein is to be understood as, though not to be considered limited to a semi punched or semi cut, such that the material is not cut completely through, but the cut is ending inside the material.

In FIG. 1, a layout 1 of a cardboard box according to the invention is depicted. The layout comprises a bottom wall 2, to which sidewalls 3, 4, 5 and 6 are connected by means of crease lines 8, 9, 10 and 11 respectively. Between each pair of adjacent side walls 3 & 4, 4 & 5, 5 & 6 and 6 & 3 connection surfaces 12, 13, 14 and 15 are respectively arranged. The connection surfaces 12, 13, 14 and 15 are provided with paired and pairwise substantially parallel crease lines 24 & 25, 26 & 27, 28 & 29 and 30 & 31 respectively.

The crease lines 8 & 9, 9 & 10, 10 & 11 and 11 & 8 cross the crease line pairs 24 & 25, 26 & 27, 28 & 29 and 30 & 31 at coinciding points 32, 33, 34 and 35 respectively. These coinciding points 32, 33, 34 and 35 are the corners of the bottom surface 2.

If the side walls 3, 4, 5 and 6 are raised up to shape a box, the connecting surfaces 12, 13, 14 and 15 fold at the paired and pairwise substantially parallel crease lines 24 & 25, 26 & 27, 28 & 29 and 30 & 31. These crease lines 24-31 are provided double, because the material gets folded face to face, such that a single crease line would be likely to tear due to the thickness of the card board material. Thus the distance between the pairs of parallel crease lines is about one to two times the thickness of the card board material of which the box is made.

Because the connecting surfaces fold inwardly, the hand grip openings shaped by the cut lines 71 and 72 and the crease lines 73 and 74 respectively are at the inside of the box covered by the connecting surfaces. Thus when a person is lifting the box, it will be impossible that his hands come into contact with the content of the box. This is advantageous, since the material contained in the box can be contagious, toxic and/or contaminated with germs.

To the sidewall 3, cover 7 is connected by means of crease line 36. The cover 7 is at its distal end provided with a connection tab 47, which comprises two affixing surfaces 48 and 49, and cut lines 50 and 51. The affixing surfaces can be glued or otherwise be affixed to the inner upper region of the sidewall 5. When affixed, the layout 1 forms a tube like structure, with the sides being open. Advantageous of this tube like structure is, that the tube can still be folded flat, such that the empty boxes can require less space.

The cut lines 50 and 51 in the affixing tab 47 and in the cover 7, provide for opening the lid 54. The opening 53 can further assist easy opening, since the user can use one or two fingers to enter and pull out the lid 54. The lid 54 is at a substantial part of its sides provided with a pair of half cut lines, as is explained in more detail with reference to FIGS. 8 and 9.

Figure 8:
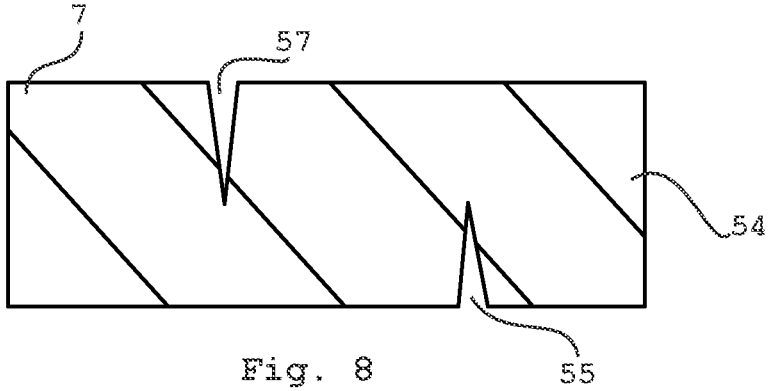
FIG. 8 depicts a schematic cross sectional view of a detail according the embodiment of the invention of FIG. 1.
Figure 9:
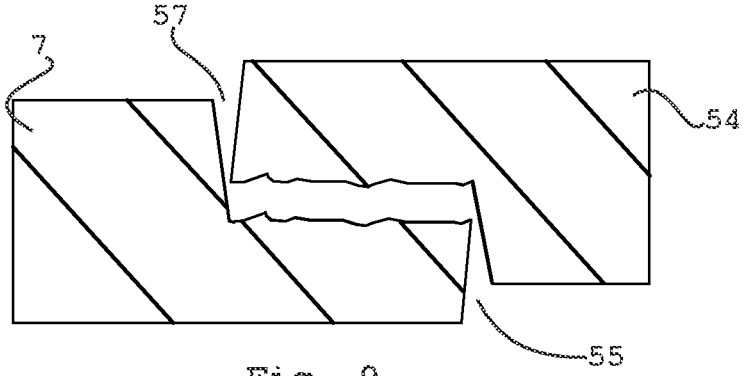
FIG. 9 depicts a schematic cross sectional view of a detail according the embodiment of the invention of FIG. 5.

In FIG. 8 a detailed cross sectional view through the card board material where the cover 7 is having a half cut 57, which is made on the outside of the box, and lid 54 is having a half cut 55, which is made on the inside of the box, such that on first time opening the lid 54, the material ruptures substantially parallel to the card board material from half cut 55 to half cut 57. Thus the lid 54 is having an overhanging portion, which closes of on the cover 7. The lid 54 can hinge with respect to the rest of the box by means of crease line 36.

The cover is further provided with two connecting tabs 39 and 40, which are respectively provided with further substantially parallel crease lines 41, 42 & 43 and 44, 45, & 46. Once the sidewalls 4 and 6 are folded inwardly the connection tab 39 can be inserted between the upper edge of the sidewall 6 and the upper edge of the connecting surfaces 14 and 15. The parallel crease lines 41, 42 and 43 help in flexing the material of the connecting tab 39 to enter the space between the side wall 6 and the connecting surfaces 14 and 15. Similarly the connection tab 40 can be inserted between the upper edge of the sidewall 4 and the upper edge of the connecting surfaces 12 and 13. The parallel crease lines 44, 45 and 45 help in flexing the material of the connecting tab 40 to enter the space between the side wall 4 and the connecting surfaces 12 and 13.

The connecting surfaces 12, 13, 14 and 15 are provided with tabs 61, 62, 63 and 64 respectively. The tabs 61 & 62 and 63 & 64 can snap pairwise into openings 59 and 60 respectively. If hereafter the connecting tabs 39 and 40 are inserted, a sturdy box is obtained, which is able to hold liquid containing material.

Figure 2:
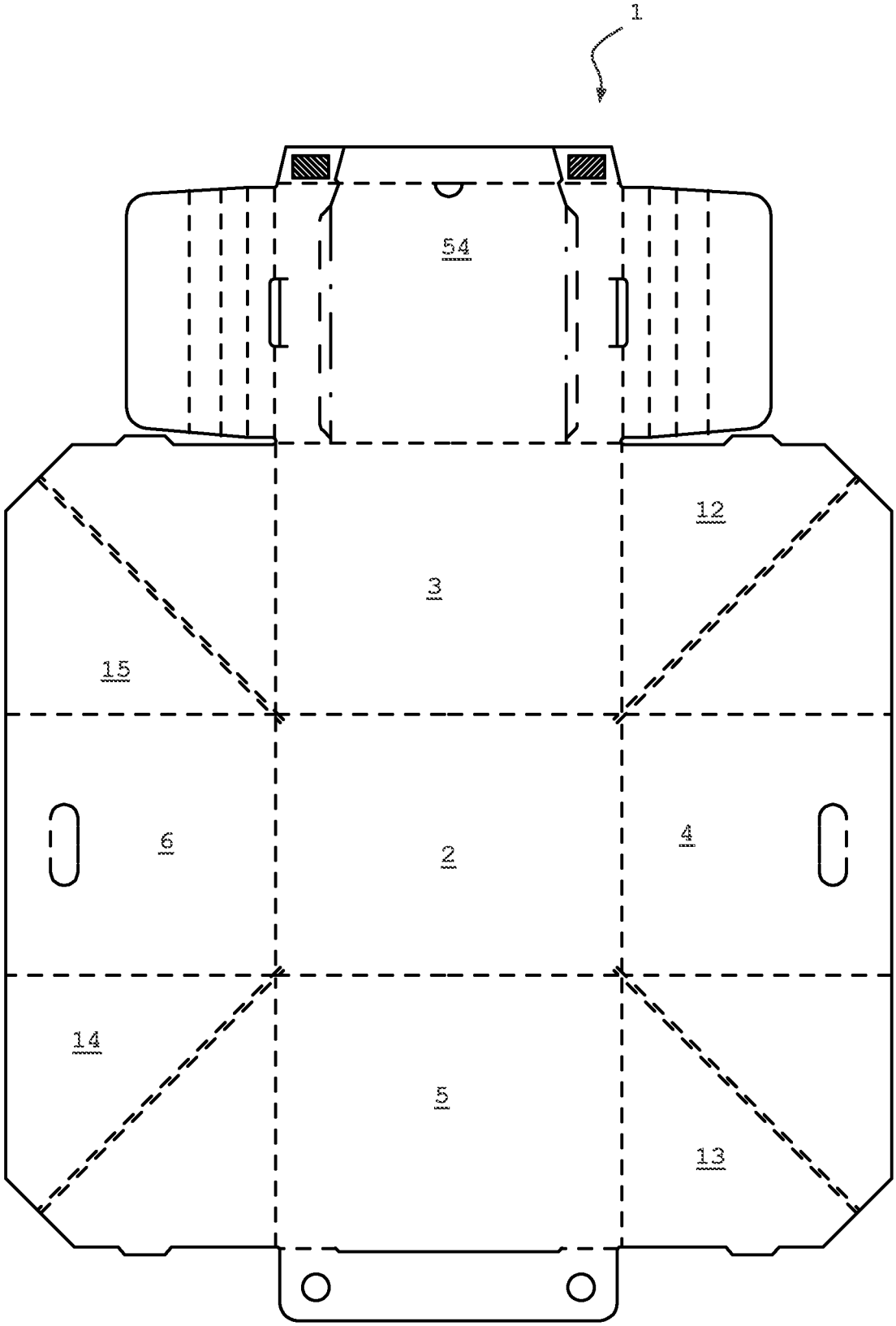
FIG. 2 depicts first schematic top side view of a layout according to a second embodiment of the invention.
Figure 3:
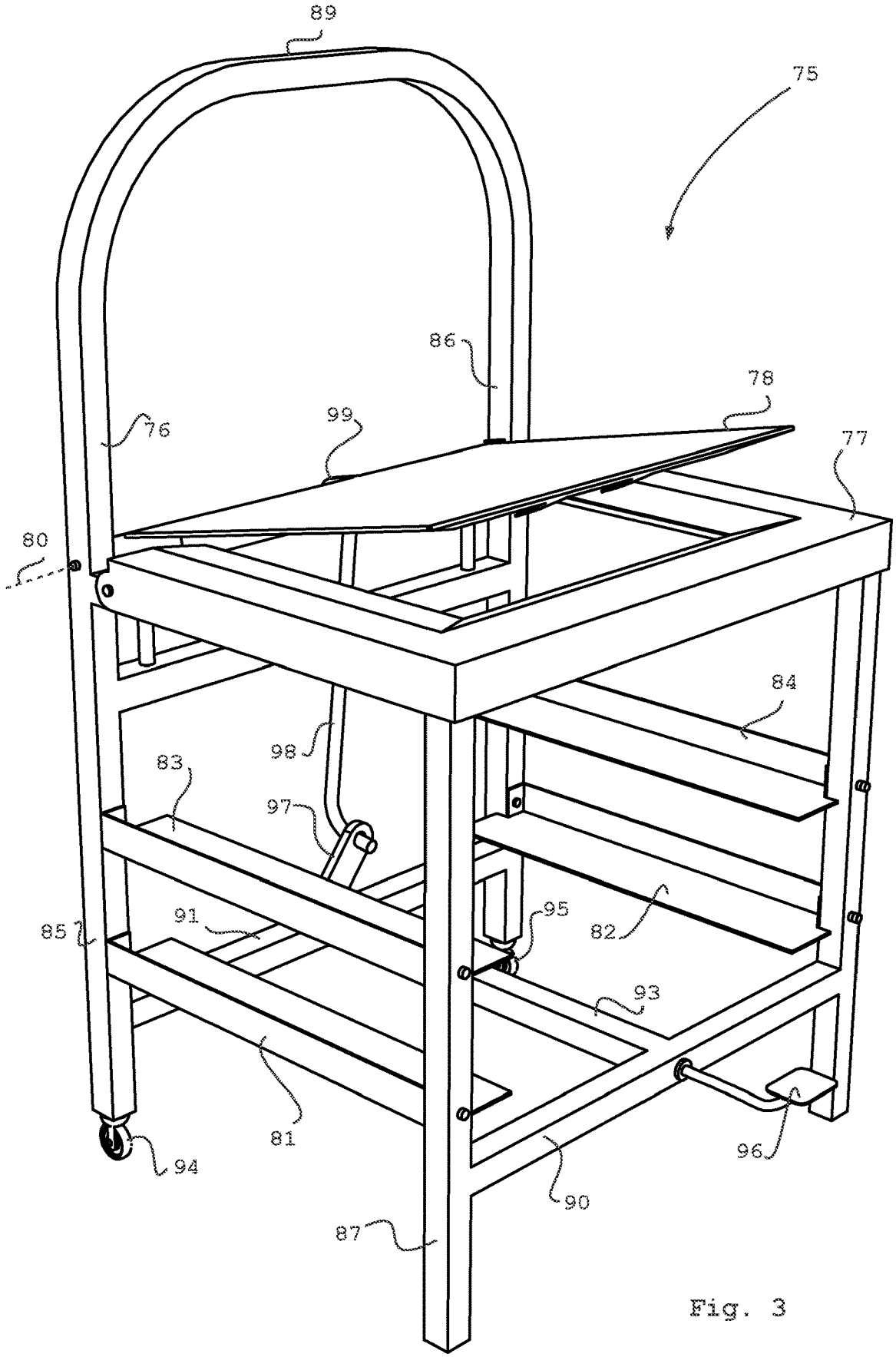
FIG. 3 depicts a schematic perspective front side view of a further embodiment of the invention.
Figure 4:
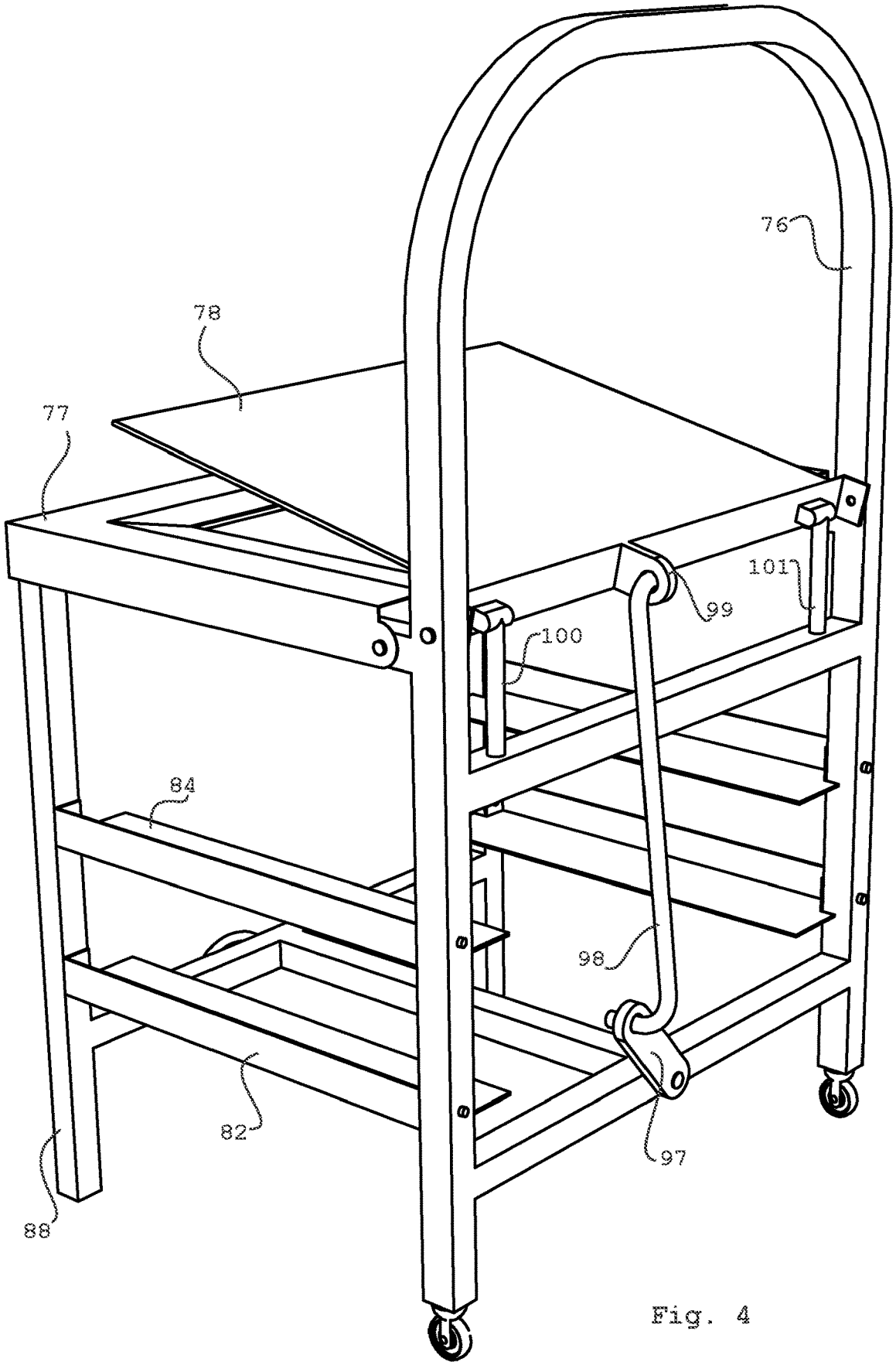
FIG. 4 depicts a schematic perspective backside view of the embodiment shown in FIG. 3.

In FIG. 2 a layout similar to the layout of FIG. 1 is depicted. The dimensions of the layout of FIG. 2 are dimensioned to hold approximately 35 litres, whereas the layout of FIG. 1 are dimensioned to hold approximately 20 litres. Both boxes are sized and dimensioned to fit into a frame 75 as is depicted in FIGS. 3 and 4. The frame 75 comprises a frame structure 76, comprising uprights 85, 86, 87 and 88 that are connected by means of beams 90, 91, 92 and 93. On the frame are mounted two hinging lids, a first lid 77 and a second lid 78.

On the second lid an eye 99 is mounted, through which a rod 98 is placed at its upper end, while the rod 98 at its lower end is connected to a lever 97. The lever 97 on its turn is connected to foot pedal 96, by a shaft being guided through the beam 93.

When pressure is exerted to the foot pedal, the lever 97 will turn, pulling the rod 98 downward, which turns the second lid 78 open. Once the pressure on the pedal 96 is relieved, the lid 78 will move back to its closed position by its weight. In order to prevent the lid 78 from banging on the lid 77, dampers 100 and 101 are installed. Between the uprights 85 and 87, two supports; lower support 81 and higher support 83 are arranged. The supports are arranged in the frame 75 in an hinging way, such that they can be turned from a supporting position into an idle position. Between the uprights 86 and 88 two further supports; lower support 82 and higher support 84 are arranged in a similar fashion. The pair of higher supports 83 & 84 are configured to bear and support a box that is represented by the layout 1 of FIG. 1 and the pair of lower supports are configured to bear and support a box that is represented by the layout of FIG. 2, as is presented in FIGS. 6 and 7.

Figure 5:
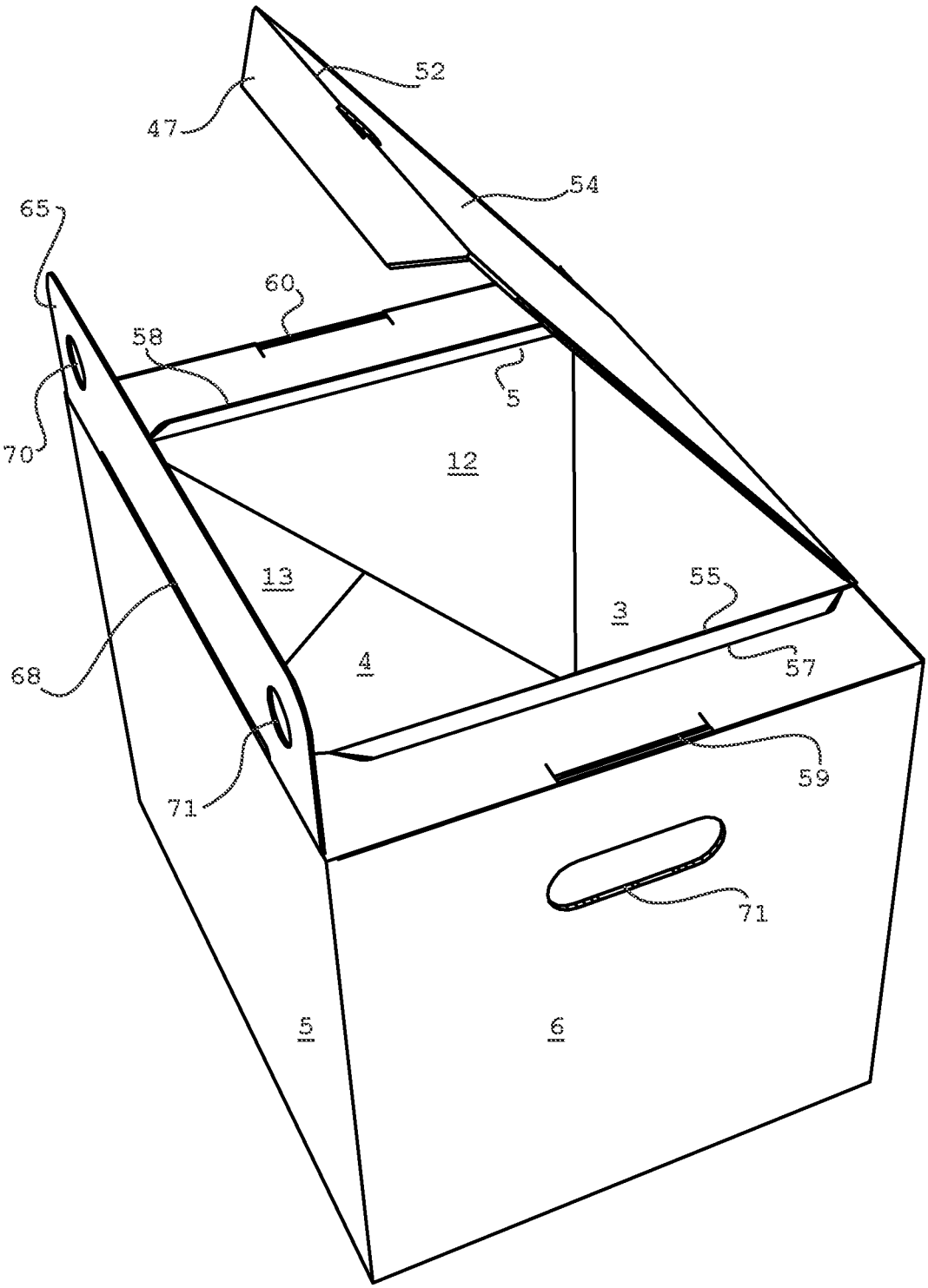
FIG. 5 depicts a schematic perspective view of still a further embodiment of the invention.

The layout as represented by FIG. 2, can be shaped into a box as is depicted in FIG. 5. In this figure, the sidewalls 3, 4, 5 and 6 are positioned in their final position, and as is visible in front of side wall 4, the connecting surfaces 12 and 13 are folded. The diagonal lines represent the original crease line pairs 24 & 25 and 26 & 27 as is depicted in FIG. 1.

On wall 5 a reinforcement tab 65 is positioned, which has an opening 68 for allowing in the connection tab 47. Thus after use, the box can be closed, and since the reinforcement tab 65 is folded downward, a number of at least five loaded boxes can be stacked, without collapsing of the lowest box.

The reinforcement tab 65 is further provided with openings 70 and 71, which render installing and removing the box from the frame 75 more practical.

Figure 6:
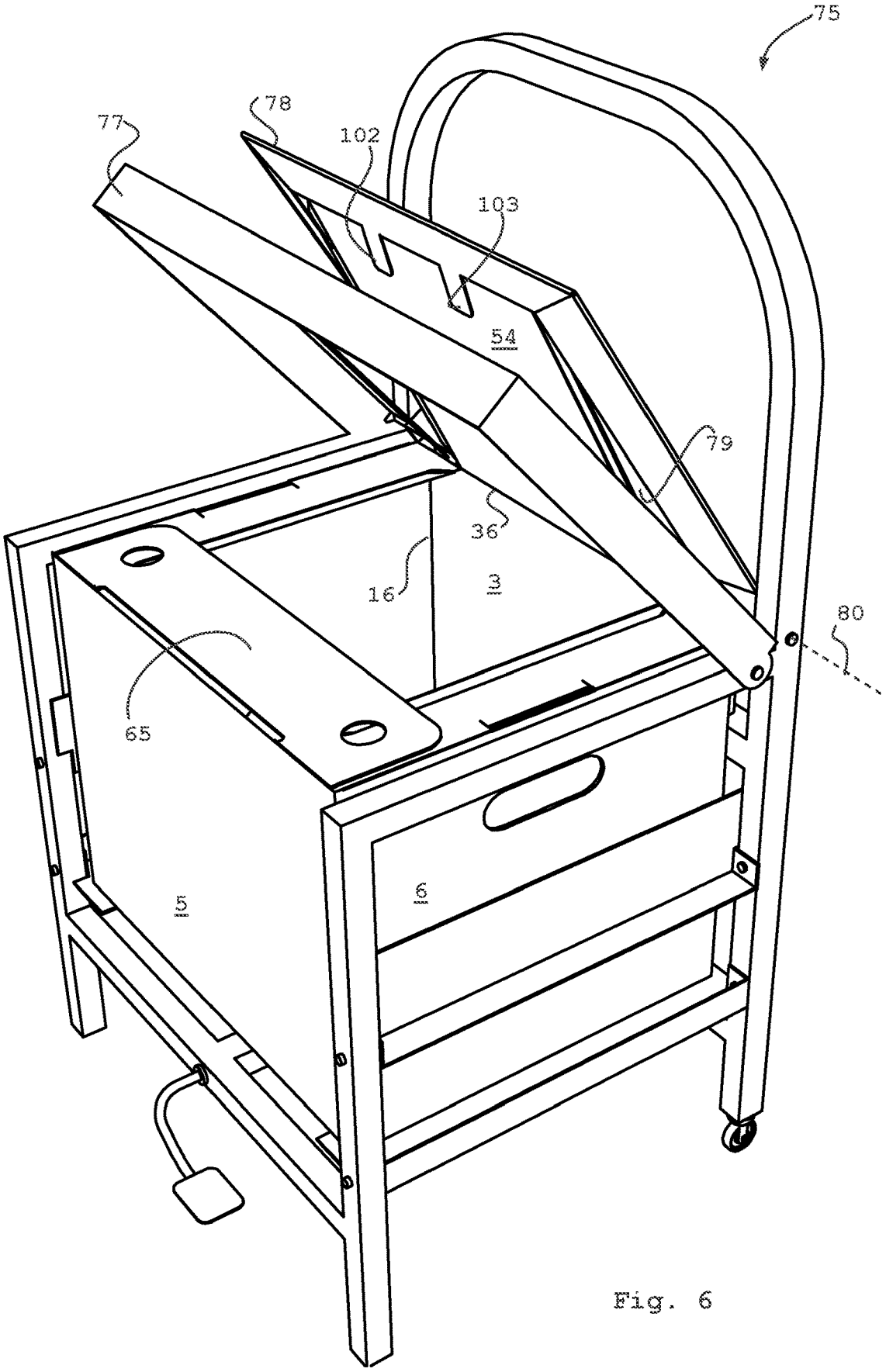
FIG. 6 depicts a schematic perspective front side view of still a further embodiment of the invention.
Figure 7:
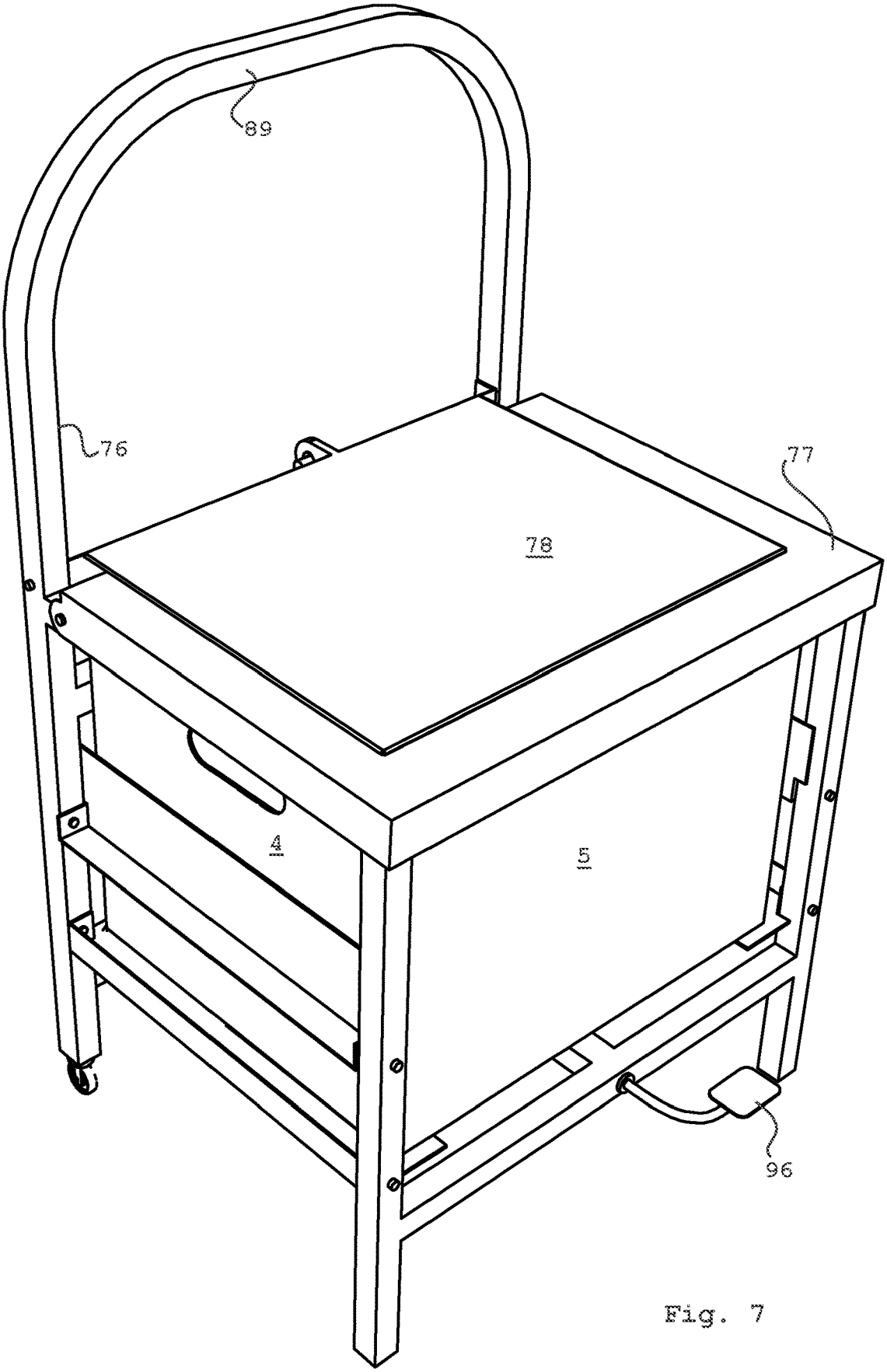
FIG. 7 depicts a schematic perspective front side view of the embodiment of FIG. 6.

In FIGS. 6 and 7 is depicted the box as represented in FIG. 5 into the frame 75 as represented by FIGS. 3 and 4. The box can be installed in the frame 75 by opening the lower lid 77. The box is installed in the frame 75 by positioning the sidewall 5, to which the lid 54 is connected to the backside of the frame 75. The upper supports 83 and 84 are positioned in their idle position, such that the box fits in between. The lower supports 81 and 82 are in their support position, such that they can bear and support the box. The lid 54 of the box can be inserted through the lower lid 77 into an engagement space 79 in the upper lid 78. The upper lid 78 is thereto provided with two inwardly directed lips 102 and 103. These lips hold the lid 54 and the connection tab 47 of the lid 54 firmly in place, such that when the upper lid 78 of the frame is lifted, the lid 54 of the box hinges as well and opens simultaneously. In order to operate smoothly, the upper lid 78 hinges around the rotation axis 80, which rotation axis 80 coincides or is spatially close to the crease line 36 of the box, about which the lid 54 of the box hinges. By this arrangement, the lid 78 can be opened numerous times, without rupturing the crease line 36.

The invention is to be understood not to be limited to the exemplary embodiments shown in the figures and described in the specification. For instance the material of construction of the box is described to be card board, however all other sheet like materials, such as plastic plates, fibre board, paper, corrugated card board, etc. etc. may be used in a similar way.

The lids 78 and 77 may be provided with seal strips of e.g. a rubber like material in order to better seal the box, once the lids are in a closed position. The frame can be dimensioned thus that the lower lid 77 is pressing against the upper side of the box, such that a better closing is obtained. The lid 77 can thereto be provided with a clicking system e.g. integrated in the upper side of the uprights 87 and 88.

These and other modifications are considered to be variations that are part of the framework, the spirit and the scope of the invention outlined in the claims.

LIST OF REFERENCE SIGNS

1. Layout
2. Bottom wall
3. Sidewall
4. Sidewall
5. Sidewall
6. Sidewall
7. Cover
8. Crease line

9. Crease line
10. Crease line
11. Crease line
12. Connecting surface
13. Connecting surface
14. Connecting surface
15. Connecting surface
16. Crease line
17. Crease line
18. Crease line
19. Crease line
20. Crease line
21. Crease line
22. Crease line
23. Crease line
24. Crease line
25. Crease line
26. Crease line
27. Crease line
28. Crease line
29. Crease line
30. Crease line
31. Crease line
32. Coinciding point
33. Coinciding point
34. Coinciding point
35. Coinciding point
36. Crease line
37. Crease line
38. Crease line
39. Connecting tab
40. Connecting tab
41. Crease line
42. Crease line
43. Crease line
44. Crease line
45. Crease line
46. Crease line
47. Connection tab
48. Affixing surface
49. Affixing surface
50. Cut line
51. Cut line
52. Crease line
53. Opening
54. Lid
55. Half cut line
56. Half cut line
57. Half cut line
58. Half cut line
59. Opening
60. Opening
61. Tab
62. Tab
63. Tab
64. Tab
65. Reinforcement tab
66. Crease line
67. Crease line
68. Cut line
69. Opening
70. Opening
71. Cut line
72. Cut line
73. Crease line
74. Crease line
75. Frame
76. Frame structure
77. First lid
78. Second lid
79. Engagement space
80. rotation axis
81. Support
82. Support
83. Support
84. Support
85. Upright
86. Upright
87. Upright
88. Upright
89. Handle
90. Beam
91. Beam
92. Beam
93. Beam
94. Roller wheel
95. Roller wheel
96. Foot pedal
97. Lever
98. Rod
99. Eye
100. Damper
101. Damper
102. Lip
103. Lip

The invention claimed is:

1. A layout for a box, having a bottom wall, four sidewalls and a cover;

wherein the sidewalls each share a crease line with the bottom wall;

wherein adjacent sidewalls share a connecting surface, which connecting surface shares a crease line with each of the two adjacent sidewalls;

wherein the connecting surfaces are provided with at least one diagonal crease line;

wherein the at least one diagonal crease line of the connecting surface coincides in one point with both crease lines between each of the adjacent sides and the bottom wall;

wherein the connecting surfaces are provided with connecting tabs;

wherein the cover is provided with openings configured for engaging with the connecting tabs of the connecting surfaces;

wherein the cover shares at its proximal side a crease line with one sidewall;

wherein the cover shares two mutually opposite crease lines with connecting tabs which are configured and shaped to fit in a space between the connecting surfaces and the sidewalls;

wherein each of the connecting tabs sharing a crease line with the cover include one or more parallel crease lines to allow flexing of the connecting tab to assist the connecting tab in entering the space between the sidewall and the connecting surfaces; and wherein each of the one or more parallel crease lines of the connecting tabs are distinct from the mutually opposite crease lines shared with the cover.

2. The layout according to claim 1, wherein the connecting surfaces are configured to be folded and arranged on the inside of the box.

3. The layout according to claim 1, wherein hand grip openings are provided in two opposing sidewalls.

4. The layout according to claim 1, wherein the cover is at its distal end provided with a connection tab, configured to be affixed to the sidewall opposing the sidewall sharing a crease line with the cover.

5. The layout according to claim 1, wherein the cover is provided with a lid, which lid is configured to hinge on the crease line between the cover and the sidewall which is connected to the cover.

6. The layout according to claim 5, wherein the lid is provided with a first half cut template, and a second half cut template, wherein the first and second half cut templates are, seen in the plane of the layout, at least partially mutually shifted and the first and second half cut are made in the material of the layout from mutually opposite sides of the material of the layout.

7. A box folded from the layout of claim 1.

8. A box according to claim 7, wherein the material is a solid cardboard.

9. A box according to claim 7, wherein an inside surface and/or an outside surface of the layout is covered with a water repelling and/or an antibacterial coating.

10. A box according to claim 9, wherein the water repelling coating comprises one or more of the following compounds: polylacticacid, polybutaricacid, polyethylene, polypropylene, polyfluorcarbon, xylan dry-film lubricants, composites of fluoropolymer-nanoparitcles, such as PE, PTFE, PFA, and FEP, and/or reinforcing thermoset polyimide and/or polyamide binder resins particularly initially suspended in suitable solvents, or polylactic acid (PLA) or other biobased materials PHA poly hydroxy acid and/or waxes such as stearine and/or parafine.

* * * * *